United States Patent [19]

Fowlkes

[11] Patent Number: 5,040,021

[45] Date of Patent: Aug. 13, 1991

[54] TRANSMISSION DENSITOMETER BY USING DIFFERENTIAL COMPARISON OF ELECTROSTATIC VOLTAGE SIGNALS

[75] Inventor: William Y. Fowlkes, Fairport, N.Y.

[73] Assignee: Eastman Kdak Company, Rochester, N.Y.

[21] Appl. No.: 516,655

[22] Filed: Apr. 30, 1990

[51] Int. Cl.[5] ..... G03G 21/00

[52] U.S. Cl. ..... 355/203; 355/208; 355/246

[58] Field of Search ..... 355/203, 246, 216, 208, 355/77

[56] References Cited

U.S. PATENT DOCUMENTS

| | | | |
|---|---|---|---|
| 3,674,353 | 7/1972 | Trachtenberg | 355/246 |
| 4,026,643 | 5/1977 | Bergman | 355/246 |
| 4,348,099 | 9/1982 | Fantozzi | 355/208 |
| 4,614,908 | 9/1986 | Daniele et al. | 355/203 X |
| 4,708,459 | 11/1987 | Cowan et al. | 355/208 X |

*Primary Examiner*—A. T. Grimley
*Assistant Examiner*—J. E. Barlow, Jr.
*Attorney, Agent, or Firm*—Milton S. Sales

[57] ABSTRACT

A transmission densitometer determines the optical density of an electrically charged layer of toner material on a photoconductive layer by exposing the photoconductive layer to radiation through the toner layer such that the amount of exposure is characteristic of the density of the toner layer. The change in voltage on the surface of the toner layer caused by the exposure is detected, such that the change in detected voltage is characteristic of the density of the toner layer. The measurement of the change in the detected voltage is carried out by measuring the characteristic voltage on a toner layer developed upon a photoconductive layer using a first electrostatic voltmeter, discharging the characteristic voltage on the area of the photoconductor which was measured by the first electrostatic voltmeter using the exposing device, and measuring the remaining voltage in that area by using a second electrostatic voltmeter. The difference between the first measured characteristic voltage and the second measured characteristic voltage on the toner layer is indicative of the amount of toner present on the photoconductive layer.

10 Claims, 1 Drawing Sheet

TRANSMISSION DENSITOMETER BY USING DIFFERENTIAL COMPARISON OF ELECTROSTATIC VOLTAGE SIGNALS

BACKGROUND OF THE INVENTION

1. Technical Field

This invention relates generally to densitometers for electrophotographic apparatus such as electrophotographic reproduction apparatus.

2. Background Art

Electrophotographic apparatus that have film belt photoconductors commonly have transmission densitometers which shine IR radiation through a toned test patch and the belt, to be detected on the other side of the belt. The detected signal is linear with respect to the mass of toner on the patch.

Electrophotographic apparatus that have drum-type photoconductors must resort to reflection densitometers because IR radiation does not pass through the drum. Reflection densitometers are inferior to transmission densitometers because the signals generated by the former are not linear with respect to the toner mass, at least at the high densities.

DISCLOSURE OF INVENTION

The invention provides a way to do transmission densitometry on a drum or other opaque substrate by using the photoconductive surface as the sensor. Light is passed through the toner layer into the photoconductor, and electrostatic voltmeter measurements of the voltage at the top surface of the toner layer gives an indication of the amount of light that passed through the toner layer.

According to the present invention, a transmission densitometer for determining the optical density of an electrically charged layer of toner material on a photoconductive layer includes means for exposing the photoconductive layer to radiation through the toner layer such that the amount of exposure is characteristic of the density of the toner layer, and means for detecting the change in voltage on the surface of the toner layer caused by the exposure, such that the change in detected voltage is characteristic of the density of the toner layer.

In a preferred embodiment of the present invention, the detecting means includes a first electrostatic voltmeter for measuring the voltage on the surface of the toner layer before the exposure and a second electrostatic voltmeter for measuring the voltage on the surface of the toner layer after the exposure. Means may be provided for applying a charge to the photoconductive layer to establish an electric field before the first voltmeter.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

This disclosure will be directed in particular to elements forming part of, or cooperating more directly with, apparatus in accordance with the present invention. It is to be understood that elements, components, and/or sub-components not specifically shown or described may take various forms well known to those skilled in the electrophotographic art.

Figure 1:
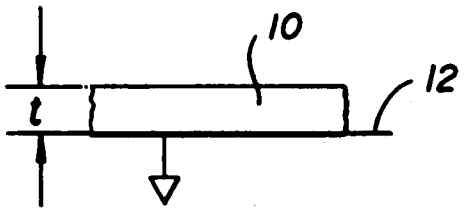
FIG. 1 is a cross-sectional view showing a toner layer on a ground plate.

Referring to FIG. 1, a charged toner layer 10 on a ground plate 12 creates a voltage "V" equal to half the space charge "$\rho$" multiplied by the thickness "t" of the toner layer squared:

$$V=\rho t^2/2\epsilon_t,$$

where $\epsilon_t$ is the permittivity of the toner layer.

The space charge $\rho$ is the unit mass "M" per unit volume "V" times the charge "Q" per unit mass "M". This cancels down to the charge per unit volume:

$$\rho=Q/V.$$

Figure 2:
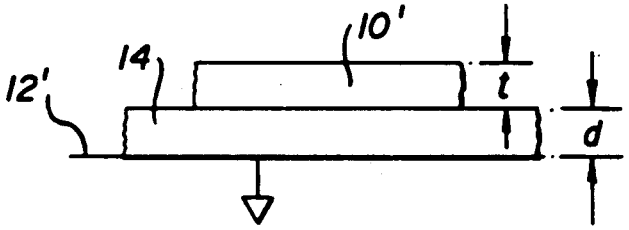
FIG. 2 is a view similar to FIG. 1 showing a photoconductor film between the toner layer and the ground plate.

Now, if a photoconductor film 14 is positioned between a toner layer 10' and a ground plate 12' as shown in FIG. 2, the voltage "V" at the top surface of the toner layer will be the sum of the voltage across the toner layer plus the voltage of in the photoconductor film:

$$V=(\rho t^2/2\epsilon_t)+(\sigma d/\epsilon_f),$$

where $\sigma/\epsilon_f$ is the field across the toner layer, $\epsilon_f$ is the permittivity of the film, d is the thickness of the photoconductive film, and $\sigma$ is the mass per unit area multiplied by the charge per unit mass. This last term cancels down to the charge per unit area of the photoconductor film:

$$\sigma=Q/A.$$

Thus, the charged toner on the film creates a field thereacross. If the film is photodischarged, the amount of discharge that occurs will depend on the amount of radiation that reaches the film. The amount of radiation that reaches the film will depend inversely on the opacity of the toner layer to the radiation.

Figure 3:
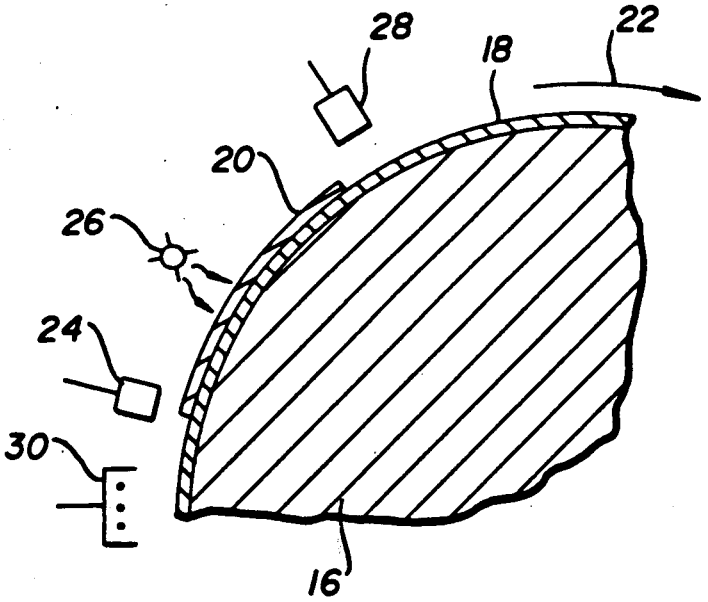
FIG. 3 is a cross-sectional view of apparatus according to an illustrated embodiment of the present invention.

Referring to FIG. 3, a electrically grounded drum 16 has a photoconductive layer 18. A latent electrostatic image has been developed to create a toner test patch 20 by conventional exposure and development stations, not shown.

As drum 16 turns in the direction of arrow 22, an electrostatic voltmeter 24 measures the voltage on the surface of toner layer 20. As the toner layer moves, it is exposed by a radiation source 26, and the voltage is again measured by a second electrostatic voltmeter 28.

The voltage difference between that read by electrostatic voltmeter 24 before exposure and that read by electrostatic voltmeter 28 after exposure is due to the voltage discharge of photoconductive layer 18 as a result of the radiation which passed through the toner layer and reached the photoconductive layer. The amount of discharge, or loss of electrical field across the film due to the radiation, can be expressed as follows:

$$\sigma_{discharge} d/\epsilon_f.$$

Best performance is attainable if there is provided a high field of the proper polarity for the type of film (i.e., positively or negatively charging). Therefore, an additional charging step may be carried out, where a large amount of charge is applied from, say, a corona charger 30, to establish a very strong field; putting the voltage on film in a range where there is substantially no nonlinearity, such that substantially every photon which reaches the film produces a charge.

Rather than using two electrostatic voltmeters 24 and 28, a single voltmeter will suffice if the drum is reversed after exposure to present the toner layer again to the single device.

The invention has been described in detail with particular reference to preferred embodiments thereof, but it will be understood that variations and modifications can be effected within the spirit and scope of the invention.

What is claimed is:

1. A transmission densitometer for determining the optical density of an electrically charged layer of toner material on a photoconductive layer, said densitometer comprising:

means for exposing the photoconductive layer to radiation through the toner layer such that the amount of exposure is characteristic of the density of the toner layer; and means for detecting the change in voltage on the surface of the toner layer caused by the exposure, such that the change in detected voltage is characteristic of the density of the toner layer.

2. A transmission densitometer as set forth in claim 1 wherein said detecting means comprises:

a first electrostatic voltmeter for measuring the voltage on the surface of the toner layer before the exposure; and a second electrostatic voltmeter for measuring the voltage on the surface of the toner layer after the exposure.

3. A transmission densitometer as set forth in claim 1 further comprising means for applying a charge to the photoconductive layer to establish an electric field before the voltage on the surface of the toner layer is detected.

4. A process for determining the optical density of an electrically charged layer of toner material on a photoconductive layer, said process comprising:

exposing the photoconductive layer to radiation through the toner layer such that the amount of exposure is characteristic of the density of the toner layer; and detecting the change in voltage on the surface of the toner layer caused by the exposure, such that the change in detected voltage is characteristic of the density of the toner layer.

5. A process as set forth in claim 4 further comprising the step of applying a charge to the photoconductive layer to establish an electric field before the voltage on the surface of the toner layer is detected.

6. A transmission densitometer for determining the optical density of an electrically charged layer of toner material on a photoconductive layer, said densitometer comprising:

means for exposing the photoconductive layer to radiation through the toner layer such that the change in electric charge on the photoconductive layer is characteristic of the density of the toner layer; and means for detecting the change in voltage on the surface of the toner layer caused by the exposure, such that the change in detected voltage is characteristic of the density of the toner layer.

7. A transmission densitometer as set forth in claim 6 wherein said detecting means comprises:

a first electrostatic voltmeter for measuring the voltage on the surface of the toner layer before the exposure; and a second electrostatic voltmeter for measuring the voltage on the surface of the toner layer after the exposure.

8. A transmission densitometer as set forth in claim 6 further comprising means for applying a charge to the photoconductive layer to establish an electric field before the voltage on the surface of the toner layer is detected.

9. A process for determining the optical density of an electrically charged layer of toner material on a photoconductive layer, said process comprising:

exposing the photoconductive layer to radiation through the toner layer such that the change in electric charge on the photoconductive layer is characteristic of the density of the toner layer; and detecting the change in voltage on the surface of the toner layer caused by the exposure, such that the change in detected voltage is characteristic of the density of the toner layer.

10. A process as set forth in claim 9 further comprising the step of applying a charge to the photoconductive layer to establish an electric field before the voltage on the surface of the toner layer is detected.

* * * * *